US007353739B2

(12) United States Patent
Ax et al.

(10) Patent No.: US 7,353,739 B2
(45) Date of Patent: Apr. 8, 2008

(54) ARRANGEMENT FOR WEAPON

(75) Inventors: Lars Ax, Tullinge (SE); Eje Lantz, Eskilstuna (SE); Kent Norgren, Karlskoga (SE); Rolf Pettersson, Torshälla (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 10/559,266

(22) PCT Filed: Jun. 2, 2004

(86) PCT No.: PCT/SE2004/000843

§ 371 (c)(1),
(2), (4) Date: Apr. 28, 2006

(87) PCT Pub. No.: WO2004/109212

PCT Pub. Date: Dec. 16, 2004

(65) Prior Publication Data

US 2006/0249011 A1 Nov. 9, 2006

(30) Foreign Application Priority Data

Jun. 5, 2003 (SE) ..... 0301626

(51) Int. Cl.
*F41A 1/10* (2006.01)

(52) U.S. Cl. ..... 89/1.701; 89/1.7; 89/1.703

(58) Field of Classification Search ..... 89/1.7–1.706; 102/437; 42/1.06

See application file for complete search history.

(56) References Cited

U.S. PATENT DOCUMENTS

| | | | | |
|---|---|---|---|---|
| 3,800,656 | A * | 4/1974 | Schnabele | 89/1.701 |
| 4,132,148 | A * | 1/1979 | Meistring et al. | 89/1.701 |
| 4,406,209 | A * | 9/1983 | Arene et al. | 89/1.701 |
| 5,099,764 | A * | 3/1992 | Dale et al. | 102/374 |
| 5,216,194 | A * | 6/1993 | Boire | 89/1.706 |
| 5,233,774 | A * | 8/1993 | Leibowitz | 42/1.09 |
| 5,337,648 | A * | 8/1994 | Brage | 89/1.704 |
| 5,551,330 | A * | 9/1996 | Reuche | 89/1.701 |
| 5,900,575 | A * | 5/1999 | Johansson et al. | 89/1.706 |
| 5,952,601 | A * | 9/1999 | Sanford et al. | 89/1.706 |
| 6,286,408 | B1 * | 9/2001 | Sanford et al. | 89/1.701 |
| 6,971,299 | B2 * | 12/2005 | Franzen et al. | 89/1.701 |
| 2005/0235816 | A1 * | 10/2005 | Franzen et al. | 89/1.701 |

FOREIGN PATENT DOCUMENTS

| | | |
|---|---|---|
| DE | 2 352 483 A1 | 4/1975 |
| GB | 2 129 105 A | 5/1984 |
| GB | 2291958 A | 2/1996 |
| SE | 444 722 B | 4/1986 |

OTHER PUBLICATIONS

European Search Report - Jun. 18, 2007.

* cited by examiner

*Primary Examiner*—Michael J. Carone
*Assistant Examiner*—Stewart T Knox
(74) *Attorney, Agent, or Firm*—Venable LLP; Eric J. Franklin

(57) ABSTRACT

An arrangement for a weapon including a countermass for reducing the pressure around the weapon. The countermass is enclosed in a countermass container that can be opened at both ends. The invention aims to bring about a symmetrical opening with favorable recoil in a better way than in previous constructions. This is achieved by the countermass including elements that can bind and retain the liquid symmetrically in a desired geometry over the cross section of the barrel and the cross section of any following expansion part.

19 Claims, 1 Drawing Sheet

ARRANGEMENT FOR WEAPON

CROSS-REFERENCE TO RELATED APPLICATIONS

This application claims priority under 35 USC § 119 to Swedish patent application no. 0301626-8 filed on 5 Jun. 2003 and is the national phase application of PCT/SE2004/000843 under 35 U.S.C. § 371.

FIELD OF THE INVENTION

The present invention relates to an arrangement for a weapon comprising a countermass for reducing the pressure around the weapon, the countermass, the main component of which is liquid, being enclosed in a container arranged in the barrel of the weapon behind an ammunition part, such as a projectile or shell, which container is designed so as, under gas pressure, to open that end of the container facing the ammunition part at a first pressure level and that end of the container facing away from the ammunition part at a second pressure level.

BACKGROUND OF THE INVENTION

In order to increase the backward momentum and thus make possible an increase in the weight of the ammunition part without excessively high pressure being created behind the weapon, it has been known for many years to introduce what is known as a countermass. When the countermass leaves the rear part of the barrel, it expands and disintegrates. A liquid cloud is formed, which is braked rapidly and produces a pressure-reducing effect adjacent to the weapon. In this connection, reference may be made to our SE patent 8205956-9 which shows an example of a weapon with countermass. Constructions with countermass are found in weapons of both single-use and multiple-use type.

During the operation when the countermass is pushed out of the barrel and any expansion part by gas pressure, it is important that the material in the countermass helps to hold the countermass together so that the transport out through the outlet of the barrel is as much in the form of a solid lump as possible without being so. In connection with the countermass being enclosed in the container, it is virtually inevitable that a certain amount of air is also enclosed. In general, it is important that as little air as possible is enclosed. Even if no large quantities of air are enclosed in known containers of countermass, the enclosed air can nevertheless cause problems. A known phenomenon is for the air to collect in the upper part of the container, which renders the countermass asymmetrical and leads to interference with the weapon when the shell is fired, which has a negative effect on the probability of the shell hitting the target. Another known phenomenon is for continuous air passages to be formed in the countermass. These air passages allow gas flowthrough and result in impaired functioning of the countermass.

SUMMARY OF THE INVENTION

The object of the present invention is to produce an arrangement for a weapon which does not have the problems mentioned above which the enclosed air can cause, but an arrangement where the air is distributed over the entire volume of the countermass and where the countermass can be held together during its transport through the barrel. This contributes to producing an arrangement for a weapon with countermass which brings about a symmetrical opening operation with favourable recoil in a better way than previous constructions.

The object of the invention is achieved by an arrangement according to the first paragraph characterized in that the countermass comprises means which can bind and retain the liquid symmetrically in a desired geometry over the cross section of the barrel and the cross section of any following expansion part.

The task of the means is to bind the liquid into a unit which, in the interballistic operation, functions as a simple coherent body and, outside the barrel, expands and functions fully as a medium which extinguishes pressure and gas. The countermass functions as a piston with a defined transverse area during the transport out of the barrel by the gas pressure. All small air bubbles in the medium are bound, distributed over the entire volume. By binding the liquid in the countermass in this way, the air is prevented from collecting at one point, in most cases at the upper edge of the container, which is disruptive for the opening operation and can have an unfavourable effect on the recoil.

The means which bind and retain the liquid symmetrically can advantageously be designed to utilize a physical chemical effect. According to an advantageous embodiment, the physical chemical effect can be based on capillary forces, and the embodiment is characterized in that the means which bind and retain the liquid symmetrically are designed to utilize capillary forces.

According to a proposed embodiment, the means which bind and retain the liquid symmetrically comprise a fine-pored sponge, such as a tile sponge. According to another proposed embodiment, the means which bind and retain the liquid symmetrically comprise material of Oasis type. According to a further proposed embodiment, the means which bind and retain the liquid symmetrically comprise viscosity-changing additives, such as gel additive or thixotropic additive. It is a common feature of the latter three embodiments that the binding and retaining means are available at relatively low cost.

According to another advantageous embodiment, the arrangement is characterized in that the means which bind and retain the liquid symmetrically comprise microballoons as liquid-carriers.

According to an advantageous development of the arrangement, a pressure compensator is introduced between the countermass in the container and that end of the container facing the ammunition part. The pressure compensator creates an environment in the countermass container which is as uniformly pressurized as possible throughout the relevant temperature range, namely between −40° and +60°. Introduction of the pressure compensator creates similar conditions for the countermass irrespective of the temperature. This in turn results in as small a variation spread as possible in the opening operation, and the best possibility for small recoil spreads has thus been created. The pressure compensator is advantageously made from a compressible material with closed cells, for example EPDM rubber.

BRIEF DESCRIPTION OF THE DRAWINGS

The invention will be described in greater detail below by means of a number of illustrative embodiments with reference to accompanying drawings in which.

DETAILED DESCRIPTION OF EMBODIMENTS OF THE INVENTION

Figure 1:
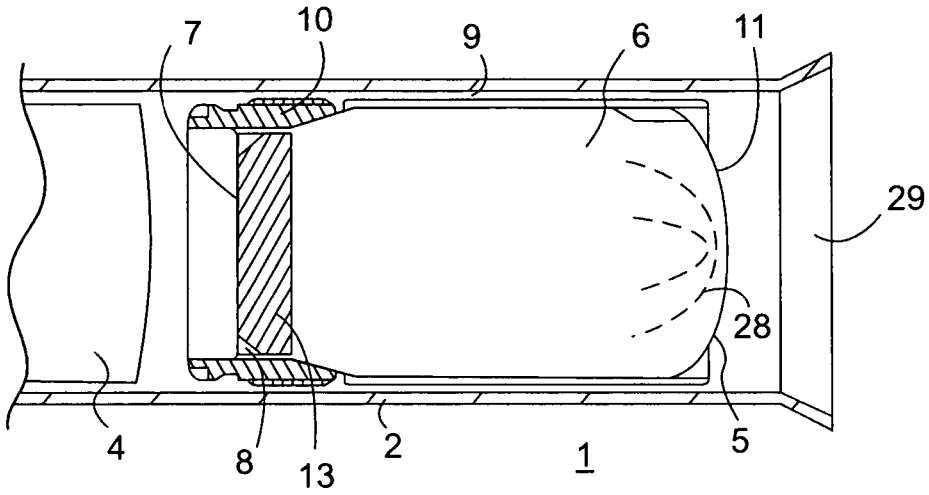
FIG. 1 shows in a longitudinal section the rear part of a weapon with an arrangement according to the invention.

The rear part of a weapon 1 shown in FIG. 1 comprises a barrel 2 accommodating an ammunition part 4 with a projectile, shell or the like, and a countermass container 5 with countermass 6. The countermass container is preferably made of titanium so as to be capable of standing up to a corrosive and aggressive countermass for a long time and at varying temperatures. The choice of material is determined primarily by lifetime requirements and temperature function requirements, and many other materials are possible. One end of the countermass container 5 is sealed by means of a cover 7. The cover may also be referred to as a bottom plate or sheet. A folding support 8 is present on the inside of the cover. The container is surrounded by a casing 9 and is provided with a collar 10 for interaction with the cover 7. The countermass container also has a bottom section 11 provided with break indications 28 marked by dashed lines. Adjacent to the inside of the cover 7 is a pressure compensator 13, which can be attached to the cover by gluing.

Figure 2:
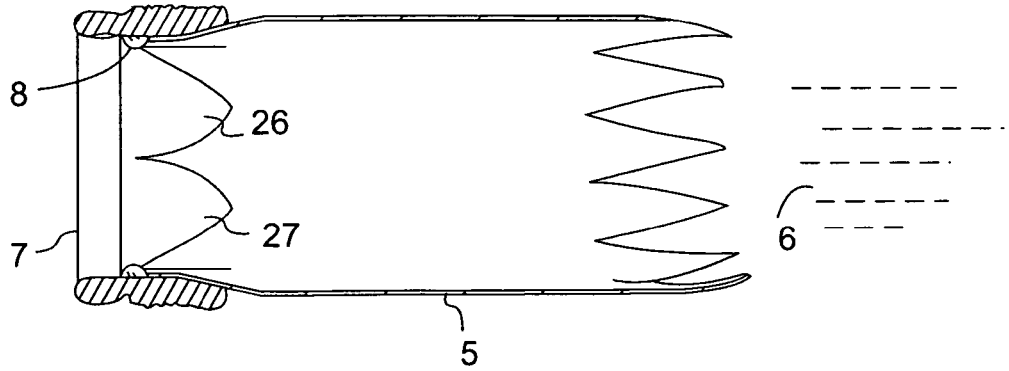
FIG. 2 shows diagrammatically in a longitudinal section an example of a countermass container with associated sealing parts after activation of the countermass, which can form part of an arrangement according to the invention.

In the situation shown in FIG. 2, the countermass container 5 has been activated. The cover 7 has been broken open, and flaps 26, 27 of the cover 7 lie bent around parts of the folding support 8. The bottom of the countermass container has been broken open guided by the break indications 28, and countermass 6 has left the container.

The activation operation of the weapon is described in greater detail below with reference to the figures described above.

When the weapon is activated, a gas pressure is delivered to the cover 7 of the countermass container. At a predetermined pressure level, the cover opens. The cover is opened from the centre out towards the periphery. The countermass container 5 is pressurized. The pressure is conveyed via the countermass 6 to the bottom section 11 of the countermass container, which, when a predetermined bursting pressure is reached, is opened guided by the break indications 28, and the countermass 6 is pushed out through the outlet 29 of the barrel 2. The pressure level when the break indications 28 in the bottom break is preferably lower than or the same as the first pressure level when the cover 7 opens.

When the countermass container is sealed, a small enclosed air volume is obtained in the container. The container is also slightly pressurized when the cover 7 is mounted. In the event of temperature variation in the countermass container, the enclosed air and the countermass will vary in volume, and the pressure also thus varies.

In order to obtain a pressure variation which is as small as possible, a pressure compensator 13 has been introduced, mounted adjacent to the cover 7. The pressure compensator 13 regulates the pressure in the container by virtue of being compressed or expanded, which means that a uniform pressure environment is created in the countermass container 5. This reduces the variation spread in the functioning of the countermass container and affords an opportunity for a smaller variation spread in the functioning of the cover. A compressible material with closed cells, such as EPDM rubber, is proposed. Here, it is proposed that the pressure compensator is glued in the cover, but it can also be positioned freely in the volume in other constructions.

It is desirable for the countermass, in terms of its functioning, to move like a piston under the influence of the gas pressure without being an actual piston. However, inter alia the small quantity of air enclosed in the container in connection with the mounting of the cover 7 on the container 5 can disrupt the operation if it is not possible to control the air volume so that it is distributed in the countermass 6. Functioning is disrupted especially if the air collects in a specific region, for example at the upper edge of the container.

In order to avoid disruption of the opening operation according to the previous paragraph, it is therefore proposed that the liquid in the countermass is bound by means which can bind and retain the liquid. The means can be based on a physical chemical effect, such as utilizing capillary forces which bind the liquid and can by their own strength retain the liquid so that an essentially homogeneous body is formed. A number of advantages are achieved. One advantage is that the countermass 6 is made to function as a piston with a defined transverse area during the transport out of the barrel 2 by the gas pressure. Another advantage is that all small air bubbles are bound in the medium distributed over the entire volume. Another physical chemical effect can be used instead of capillary forces.

Examples of means which can be used for binding and retaining the liquid are a fine-pored sponge, such as a tile sponge, material of Oasis type or gel additive or thixotropic additive. Another alternative is for the means to include microballoons as liquid-carriers.

At the rear opening of the barrel, the built-in pressure in the countermass will cause the countermass to expand and disintegrate. This brings about rapid braking of the liquid cloud at the same time as liquid is a very good extinguisher of a following gas cloud. Rapid braking of the cloud is brought about at the same time as a considerable pressure-reducing effect is produced adjacent to the weapon.

The invention is not limited to the embodiments shown as examples above but can undergo modifications within the scope of the patent claims below. In particular, it may be pointed out that the arrangement can be applied in many different systems with varying firing principles and where it is desirable to reduce the pressure spread around the weapon with the aid of a countermass in liquid form. Examples of systems are various types of antitank rifle and systems for rocket launching.

The invention claimed is:

1. An arrangement for a weapon comprising a barrel, the barrel comprising an outlet, the arrangement comprising:

an ammunition part arranged in the barrel;

a countermass container arranged in the barrel behind the ammunition part, the container comprising a first end facing the ammunition part and a second end opposite the first end; and a countermass arranged in the countermass container, a main component of the countermass comprising liquid, the countermass comprising binding and retaining means to bind and retain the liquid, the binding and retaining means comprising a sponge;

wherein under gas pressure the first end of the container opens at a first pressure level and the second end of the container opens at a second pressure level.

2. The arrangement according to claim 1, wherein the binding and retaining means binds and retains the liquid symmetrically over the cross section of the barrel.

3. The arrangement according to claim 1, wherein the binding and retaining means binds and retains the liquid symmetrically over the cross section of the outlet of the barrel.

4. The arrangement according to claim 1, wherein the countermass reduces an increase in pressure around the weapon after firing of the weapon.

5. The arrangement according to claim 1, wherein the ammunition part comprises a projectile or a shell.

6. The arrangement according to claim 1, wherein the countermass further comprises viscosity-changing additives.

7. The arrangement according to claim 1, further comprising:

a pressure compensator arranged in the countermass container between the countermass and the first end of the container.

8. The arrangement, according to claim 7, wherein the pressure compensator comprises a compressible material with closed cells.

9. The arrangement according to claim 7, wherein the pressure compensator comprises ethylene propylene diene monomer rubber.

10. The arrangement according to claim 1, wherein the binding and retaining means comprises a tile sponge.

11. The arrangement according to claim 1, wherein the countermass further comprises gel additive or thixotropic additive.

12. An arrangement for a weapon comprising a barrel, the barrel comprising an outlet, the arrangement comprising:

an ammunition part arranged in the barrel;

a countermass container arranged in the barrel behind the ammunition part, the container comprising a first end facing the ammunition part and a second end opposite the first end; and a countermass arranged in the countermass container, a main component of the countermass comprising liquid, the countermass comprising binding and retaining means to bind and retain the liquid, the binding and retaining means comprising microballoons as liquid-carriers;

wherein under gas pressure the first end of the container opens at a first pressure level and the second end of the container opens at a second pressure level.

13. The arrangement according to claim 12, wherein the countermass reduces an increase in pressure around the weapon after firing of the weapon.

14. The arrangement according to claim 12, wherein the ammunition part comprises a projectile or a shell.

15. The arrangement according to claim 12, wherein the countermass further comprises viscosity-changing additives.

16. The arrangement according to claim 12, further comprising:

a pressure compensator arranged in the countermass container between the countermass and the first end of the container.

17. The arrangement according to claim 16, wherein the pressure compensator comprises a compressible material with closed cells.

18. The arrangement according to claim 16, wherein the pressure compensator comprises ethylene propylene diene monomer rubber.

19. The arrangement according to claim 12, wherein the countermass further comprises gel additive or thixotropic additive.

* * * * *